US006343848B2

(12) United States Patent
Berg et al.

(10) Patent No.: US 6,343,848 B2
(45) **Date of Patent: *Feb. 5, 2002**

(54) METHOD AND APPARATUS FOR TRANSFERRING HEAT FROM A THERMAL INKJET PRINTHEAD SUBSTRATE USING A HEAT SINK

(75) Inventors: Richard H. Berg, Greece; Peter J. Nystrom, Webster, both of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/232,820

(22) Filed: Jan. 19, 1999

(51) Int. Cl.[7] ..... B41J 29/377

(52) U.S. Cl. ..... 347/18

(58) Field of Search ..... 347/18, 207, 223, 347/49, 87; 400/174, 175, 124.13

(56) References Cited

U.S. PATENT DOCUMENTS

| | | | | | |
|---|---|---|---|---|---|
| 4,821,051 | A | * | 4/1989 | Hediger | 347/130 |
| 4,998,433 | A | * | 3/1991 | Stumpf et al. | 73/25.01 |
| 5,079,567 | A | * | 1/1992 | Beaman et al. | 346/139 R |
| 5,343,230 | A | * | 8/1994 | Dietl | 347/31 |
| 5,373,099 | A | * | 12/1994 | Boitard et al. | 174/16.3 |
| 5,751,316 | A | | 5/1998 | Bailey et al. | 347/63 |
| 5,871,292 | A | * | 2/1999 | Johnson et al. | 347/37 |
| 5,880,754 | A | * | 3/1999 | Niikura et al. | 347/18 |

FOREIGN PATENT DOCUMENTS

JP 409076485 A * 3/1997 ..... B41J/2/01

OTHER PUBLICATIONS

Thermagon, Inc., News Release [online], Jul. 27, 1997 [retrieved on Oct. 30, 2000]. Retrieved from the Internet: <url:http://www.thermagon.com/news.htm>.*

* cited by examiner

*Primary Examiner*—John Barlow
*Assistant Examiner*—Julian D. Huffman
(74) *Attorney, Agent, or Firm*—Oliff & Berridge, PLC

(57) ABSTRACT

A heat sink, provides a heat transfer pathway to remove heat from the rear face of a printhead substrate. The heat sink is located between the printhead substrate and the printer carriage. The heat sink may, in one embodiment, be biased to float substantially normal to the rear face of a printhead substrate using a biasing device, such as one or more springs, or a one or more spring clips. The springs, which are compressed, tend to urge the face of the heat sink against the back face of the printhead, forming an interface between the two faces. Additional force can be provided by a carriage arm, as its radius acts as a moment arm to assist in pressing the two faces together. A low thermal heat conductivity contact resistance and an improved thermal resistance to heat dissipation between the printhead substrate and the heat sink are provided by the high pressure interface resulting from the use of the springs and the radius of the carriage arm. An additional layer of heat conductive material can be provided at the interface of the heat sink and the printhead substrate. This can reduce the ability of air pockets to form between the heat sink and the printhead substrate. The additional layer is a fabric or thermal grease material which is effective to fill rough areas of surface on either the printhead substrate or the heat sink contact areas.

20 Claims, 8 Drawing Sheets

FIG. 1
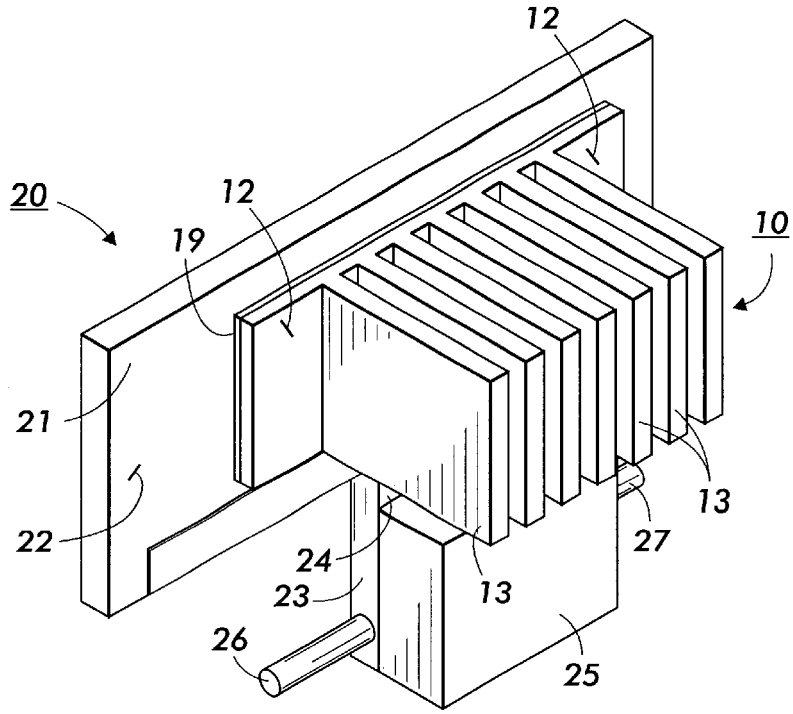
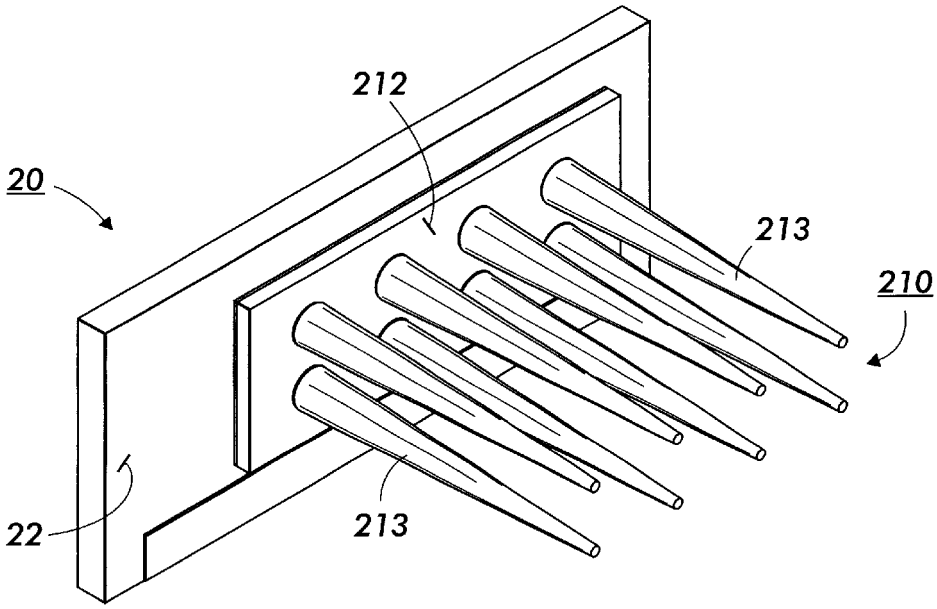
FIG. 2

FIG. 9
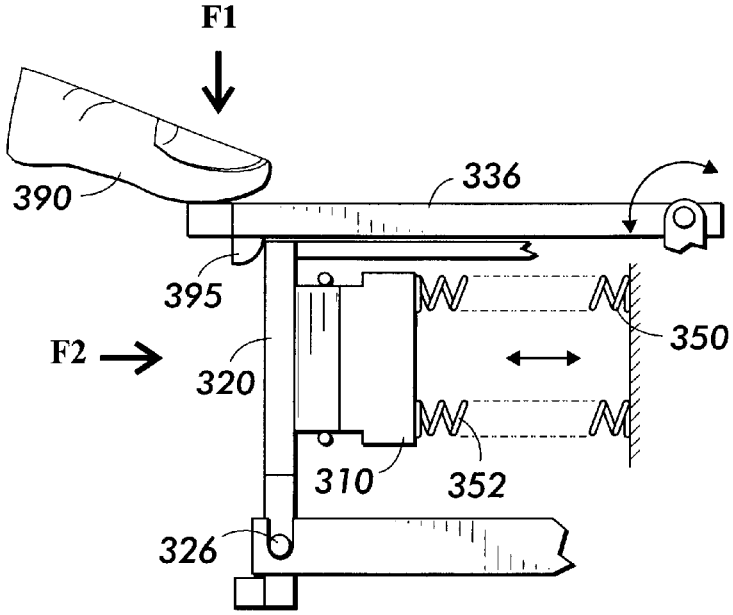
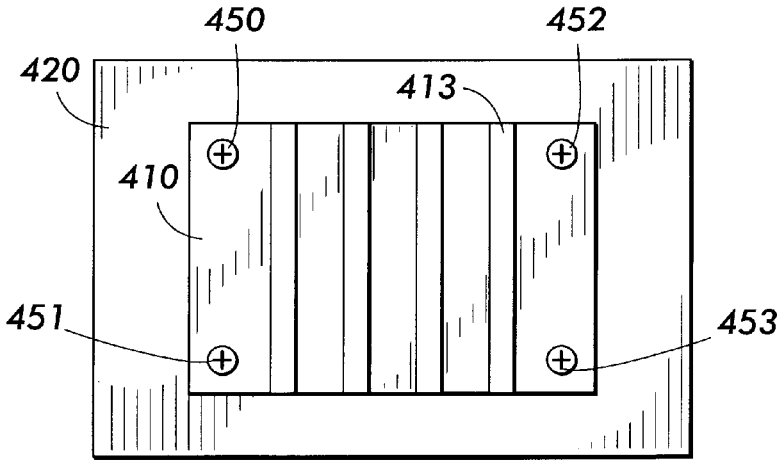
FIG. 10

METHOD AND APPARATUS FOR TRANSFERRING HEAT FROM A THERMAL INKJET PRINTHEAD SUBSTRATE USING A HEAT SINK

BACKGROUND OF THE INVENTION

1. Field of Invention

This invention relates to improvements in heat transfer from thermal inkjet printing devices. More particularly, this invention is directed to methods and apparatus for positioning a heat sink against a thermal inkjet printhead substrate to increase the efficiency of heat dissipation from the substrate.

2. Description of Related Art

Thermal inkjet printers generally include a thermal printhead for ejecting ink onto a recording medium, such as, for example, paper. The thermal printhead has a plurality of ink channels formed in a substrate of the printhead. Each channel has a resistor to heat and selectively vaporize ink near the nozzle of that capillary filled ink channel. The vaporized ink forms a bubble that temporarily expels an ink droplet and propels it toward the paper. Carriage type inkjet printers include a carriage which moves the printhead across the face of the paper.

SUMMARY OF THE INVENTION

Thermal inkjet printhead substrates become heated as a result of the process which is used to vaporize the ink. Excess heat is generally allowed to slowly dissipate into the surrounding environment. The amount of space available within the printer casing is typically limited. Thus, it has proven difficult to provide efficient methods and devices that efficiently remove heat from the printhead substrate to the surrounding air. This has become more critical in view of the increased emphasis on reduced printer case footprints and higher through-put (pages per minute) abilities, particularly in carriage-type inkjet printers.

This invention provides methods and apparatus that provide an effective heat transfer pathway to remove heat from a thermal inkjet printhead substrate.

This invention separately provides a heat sink positioned against the back face of the substrate that forms an effective heat transfer pathway.

According to an exemplary embodiment of the method and apparatus of this invention, a heat sink, preferably of the finned plate type, is adapted to provide a heat transfer pathway to remove heat from the rear face of a printhead substrate. The heat sink is preferably located between the printhead substrate and the printer carriage. The heat sink may, in one embodiment, be biased to float substantially normal to the rear face of a printhead substrate using a biasing device, such as a spring or springs, or a spring clip or spring clips or other clamps or clamping mechanisms. The springs, which are compressed, tend to urge the face of the heat sink against the back face of the printhead, forming an interface between the two faces.

The springs produce an amount of force effective to press the heat sink against the substrate. Additional force is provided using the carriage arm, as its radius acts as a moment arm to assist in pressing the two faces together, which makes it easier for an individual to lock the printhead in position against the force of the springs. A low thermal heat conductivity contact resistance and an improved thermal resistance to heat dissipation between the printhead substrate and the heat sink are provided by the high pressure interface resulting from the use of the springs and the radius of the carriage arm.

An additional layer of heat conductive material is preferably provided at the interface of the heat sink and the printhead substrate to reduce the ability of air pockets to form between the heat sink and the printhead substrate. The additional layer is preferably a gap filler material such as a heat conductive polymer, an interface adhesive, liquid heat sinks, fabric, thermal grease or other thermal interface material or materials material that are effective to fill rough areas of surface on the printhead substrate and/or on the heat sink contact areas. Without the additional layer, such rough contacting surfaces may produce air pockets which can reduce the efficiency of heat transfer out of the printhead substrate and into the heat sink.

BRIEF DESCRIPTION OF THE DRAWINGS

The preferred embodiments of this invention will be described in detail, with reference to the following drawing figures, in which:

FIG. 1 is a perspective view of one exemplary embodiment of a finned plate heat sink positioned at the back face of a thermal inkjet printhead substrate according to this invention;

FIG. 2 is a perspective view of one exemplary embodiment of a pinned plate heat sink positioned at the back face of a thermal inkjet printhead substrate according to this invention;

FIG. 9 is a schematic side view of an exemplary embodiment of a heat sink according to this invention using springs to bias a heat sink against an inkjet printhead substrate; and FIG. 10 is a schematic view of an exemplary embodiment of a heat sink according to this invention using fasteners to position a heat sink against an inkjet printhead substrate.

DETAILED DESCRIPTION OF PREFERRED EMBODIMENTS

Figure 3:
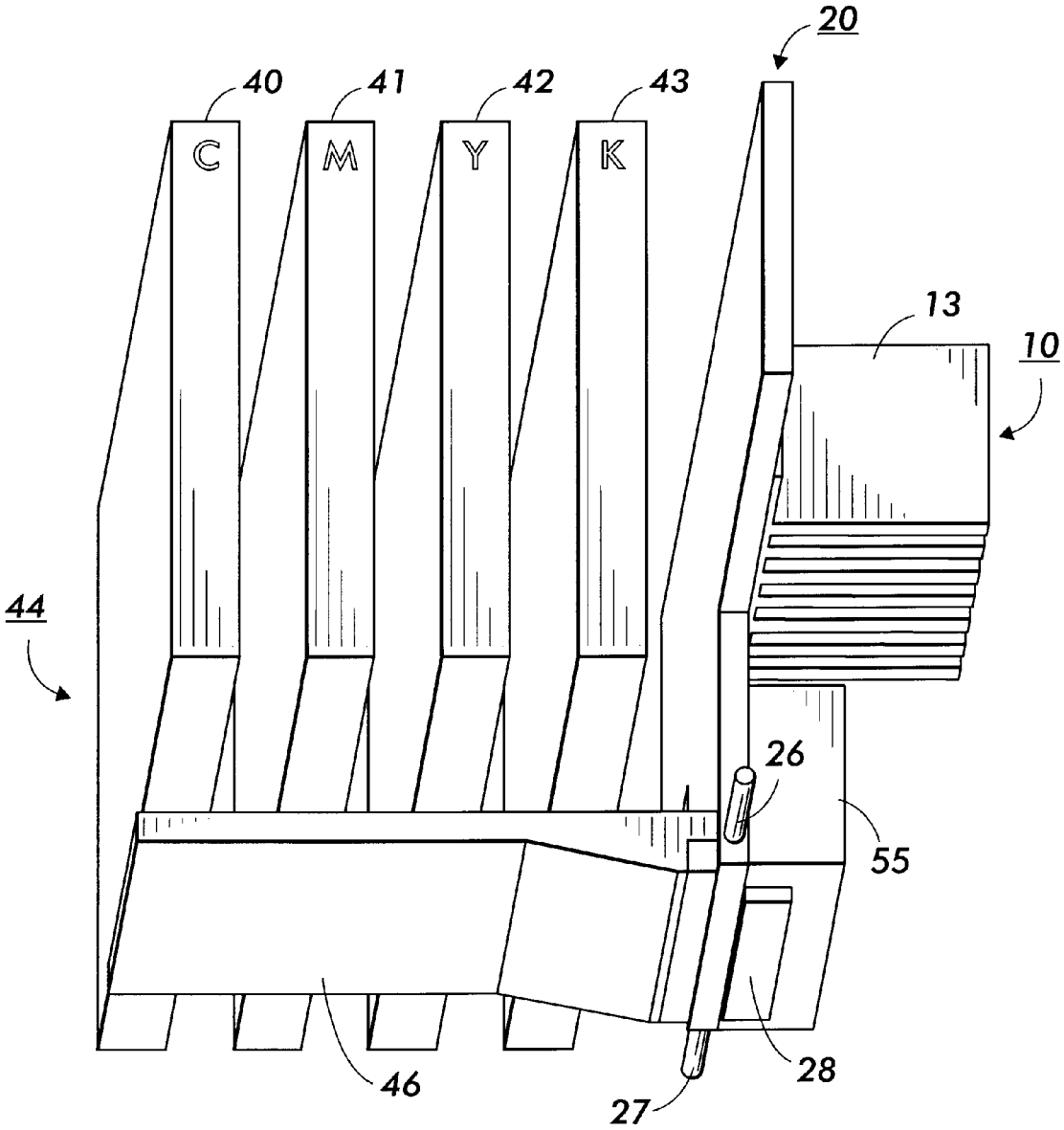
FIG. 3 is a perspective view of one exemplary embodiment of an ink cartridge with ink tanks including an inkjet printhead substrate onto which is positioned a finned plate heat sink according to this invention.

FIG. 1 generally shows an exemplary embodiment of a heat sink 10 positioned next to a printhead substrate 20 of a thermal ink jet printhead. The heat sink 10 preferably includes a base 12 from which a plurality of heat transfer surfaces outwardly extend. In this exemplary embodiment, the heat transfer surfaces are preferably fins 13. In the heat sink 10 shown in FIG. 1, seven fins 13 extend from the base 12, although any suitable and effective number and size for the fins 13 may be used. The heat sink 10 may alternatively take forms other than the fins shown in FIG. 1, such as the extended pins 213 extending from the base 212 of the heat sink 210 shown in FIG. 2, for example. An advantage of this invention is that different heat sink constructions can be alternatively used with a single printhead substrate, depending upon the heat transfer characteristics required for, and the space limitations of, the particular installation of the printhead.

As shown in FIG. 1, the printhead substrate 20 preferably includes a top section 21, having a back face 22, and a bottom section 23, having a back face 24.

An ink manifold 25 is mounted to the back face 24 of the bottom section 23. Pivot pins 26 and 27 extend out of the sides of bottom section 23.

The heat sink 10 is positioned against the back face 22 of the upper section 21 of the printhead substrate 20. A layer 19 of conductive heat transfer material is preferably provided between the base 12 of the heat sink 10 and the back face 21. Examples of suitable heat conductive materials include a gap filler material such as a heat conductive polymer, an interface adhesive, liquid heat sinks, fabric, thermal grease or other thermal interface material or materials that are effective to fill rough areas of surface on the printhead substrate and/or on the heat sink contact areas, although any suitable material can be used. The material preferably is one that improves the heat conductivity path between the substrate 20 and the heat sink 10. The heat conductivity path can be improved, for example, by decreasing the ability of air pockets to form between the surfaces of the substrate 20 and the heat sink 10. The formation of such air pockets may lower the efficiency of the heat transfer out of the substrate 20. While it is preferred to include the layer 19 of material, the closer to perfectly flat and smooth the surfaces of the substrate 20 and the heat sink 10 are made, the lower the contact resistance will be and the higher the heat transfer will be between the two without any layer 19. However, economics will usually dictate that it is more feasible to provide a layer 19 than to make perfectly flat surfaces.

In one embodiment of the heat sink 10 of this invention, the layer 19 may comprise an adhesive which adheres the heat sink 10 to the back 22 of the substrate 20. An adhesive which is effective to improve the heat conductivity between the substrate 20 and the heat sink 10 is another material preferably used as the layer 19. The layer 19 may also comprise a combination of an adhesive and another heat transfer medium, such as those discussed above, for example.

FIG. 3 shows the heat sink 10 positioned against the back face of a printhead substrate 20, to which is attached an ink cartridge 44. The ink cartridge 44 includes at least one ink tank, and preferably four ink tanks, including a cyan (c) ink tank 40, a magenta (m) ink tank 41, a yellow (y) ink tank 42, and a black (k) ink tank 43. Each of the ink tanks 40–43 is mounted to an ink feed 46, which may also act as a support for the ink tanks 40, 41, 42 and 43. The ink feed 46 feeds ink from the ink tanks 40–43 to the ink manifold 55. The manifold 55 supplies the inks to a printhead 28.

FIGS. 4–8 show one exemplary embodiment of the heat sink of this invention, in which a heat sink 110 is held in position by one or more biasing devices, such as the pair of compressed springs 50 and 52. An exemplary prototype of the springs 50 and 52 was formed by removing the clip parts of spring clips, leaving only the spring sections.

An ink jet support carriage 30 includes a carriage base or back 32, a carriage bottom 34, a carriage top or latch 36, and a scan tracking section 37. The scan tracking section 37 features a tracking hole or passage 38 having a scan axis 39. The carriage 30 can be conventionally installed on alignment pins (not shown) passing through the passage 38 to move the carriage 30 across the face of a sheet of paper (not shown).

The springs 50 and 52 are preferably fixed to the carriage back 32. Alternatively, the springs 50 and 52 may be fixed to the heat sink 10, to both the heat sink 10 and the carriage back 32, or not attached to either, in which case spring guide pieces (not shown) may be included to maintain the position of the springs 50 and 52.

Figure 4:
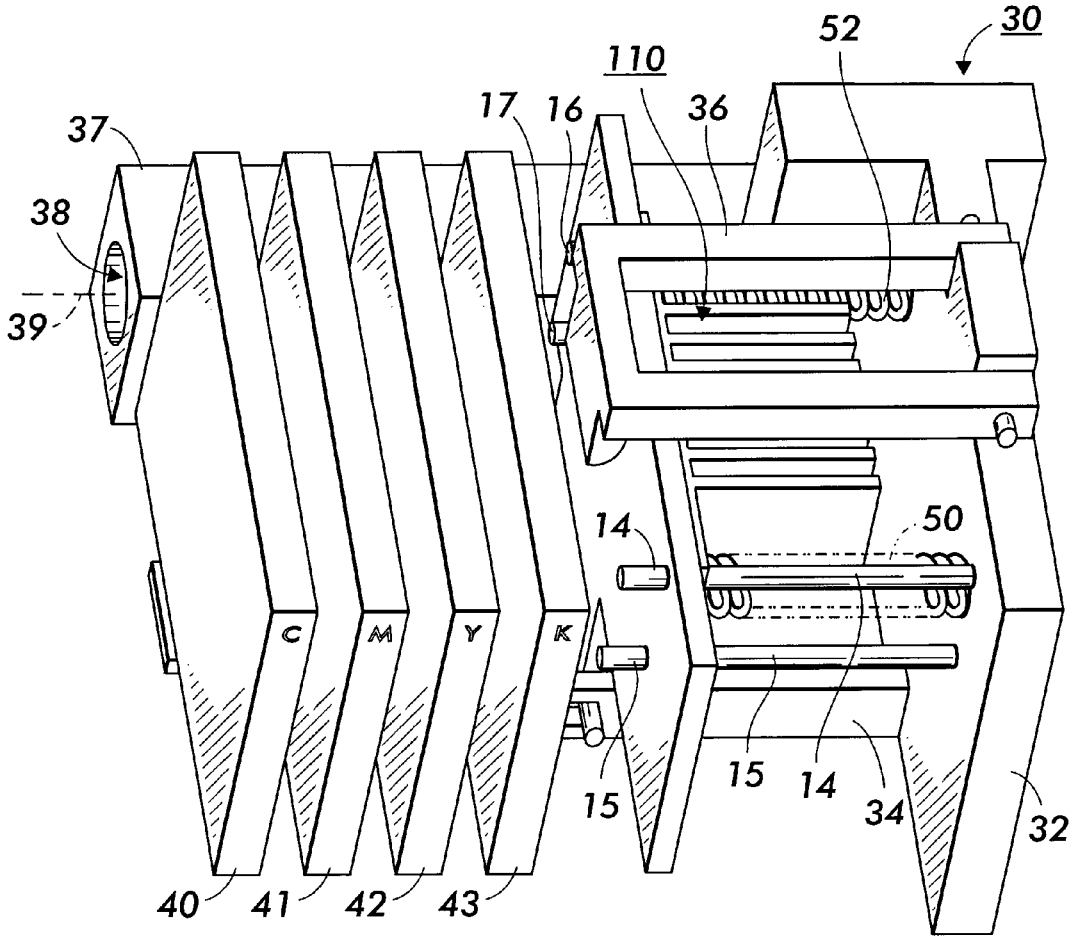
FIG. 4 is a perspective view of one exemplary embodiment of an ink cartridge including a printhead substrate, onto which is positioned a heat sink, and an inkjet carriage support according to this invention.
Figure 5:
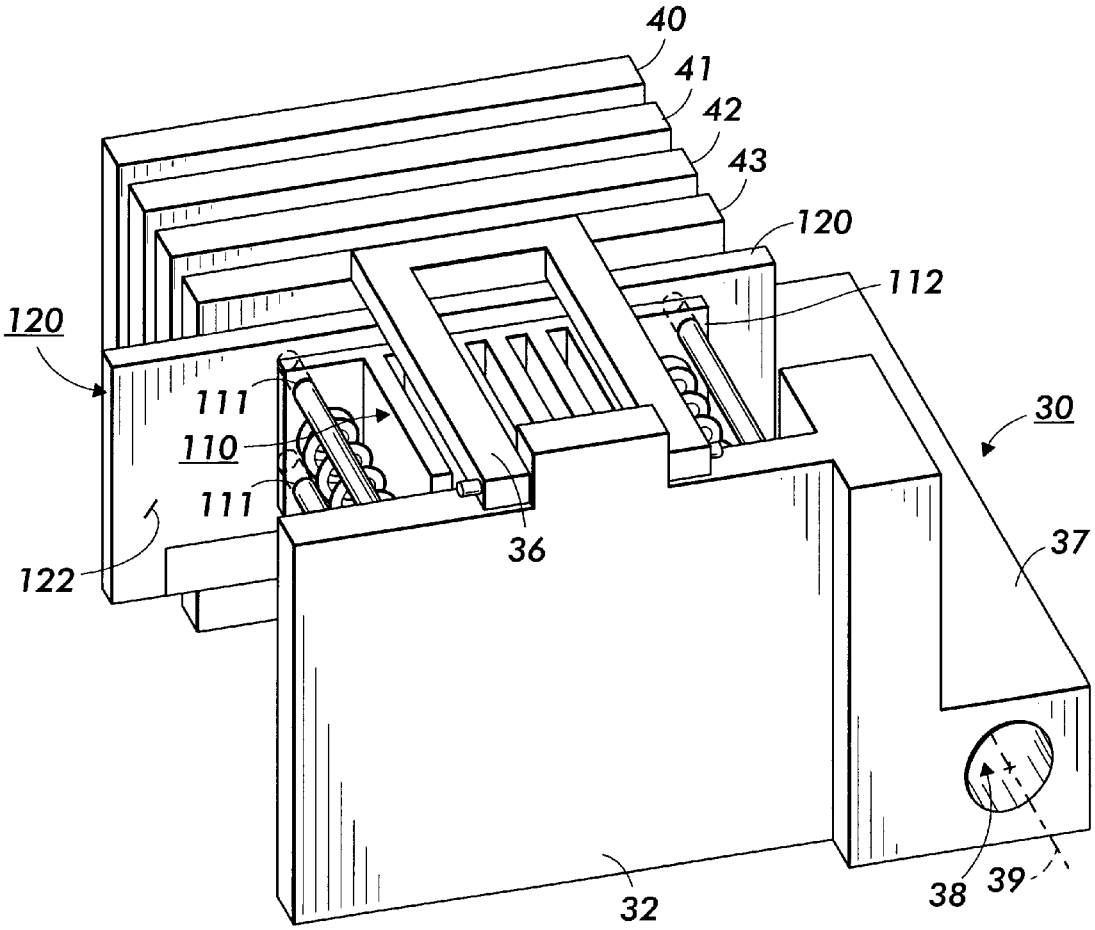
FIG. 5 is another perspective view of the exemplary embodiment of the heat sink of this invention shown in FIG. 4.

As shown in FIG. 5, the heat sink 110 is preferably constructed with a number of holes 111 near the corners of the heat sink to provide a structure that guides the heat sink 110 toward the face 122 of the inkjet substrate 120. As shown in FIG. 4, a number of guide pins or rails 14, 15, 16 and 17, which correspond with the holes 111, are provided to extend to the inkjet substrate 120 to guide the heat sink 110 against the face 122 of the inkjet substrate 120.

Figure 7:
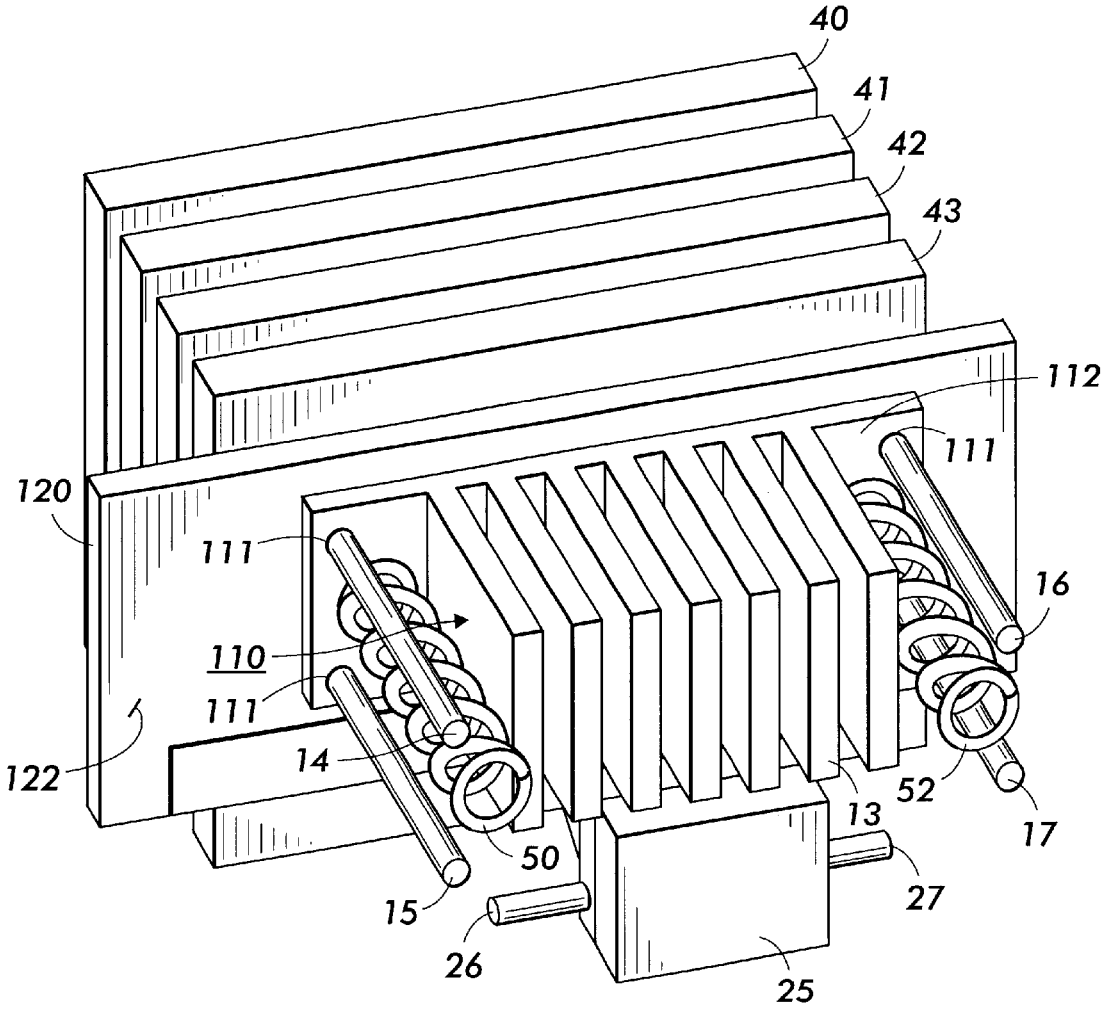
FIG. 7 is another perspective view of a portion of the exemplary embodiment of the heat sink of this invention shown in FIG. 4.
Figure 8:
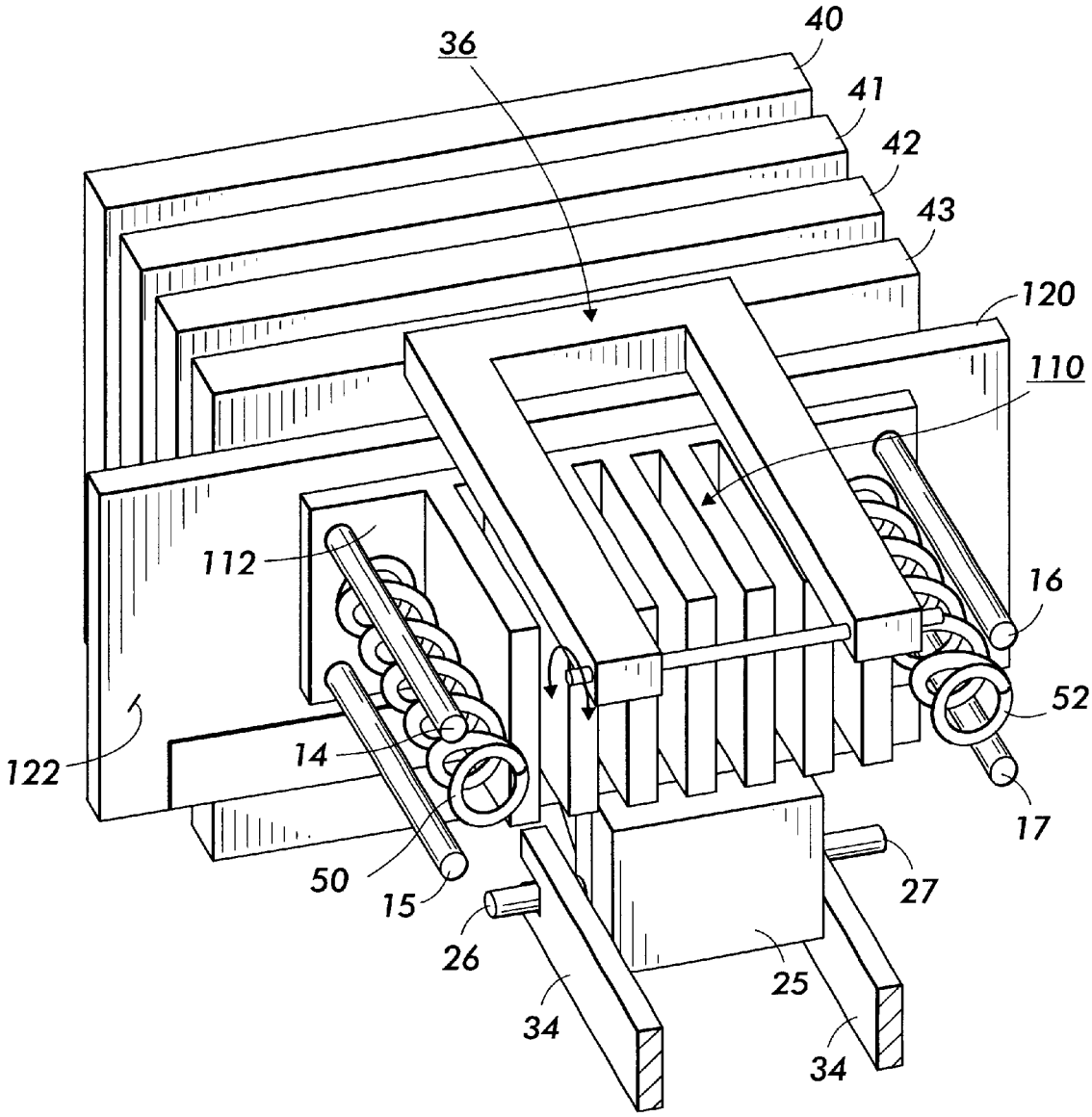
FIG. 8 is another perspective view of a portion of the exemplary embodiment of the heat sink of this invention shown in FIG. 4.

The support carriage 30 is preferably maintained in position over the printhead substrate 120 by means of the carriage latch 36, which pivots to latch over the top of the substrate 120. As shown in FIG. 7, the printhead 120 is maintained in position by the printhead pivot pins 26 and 27.

Figure 6:
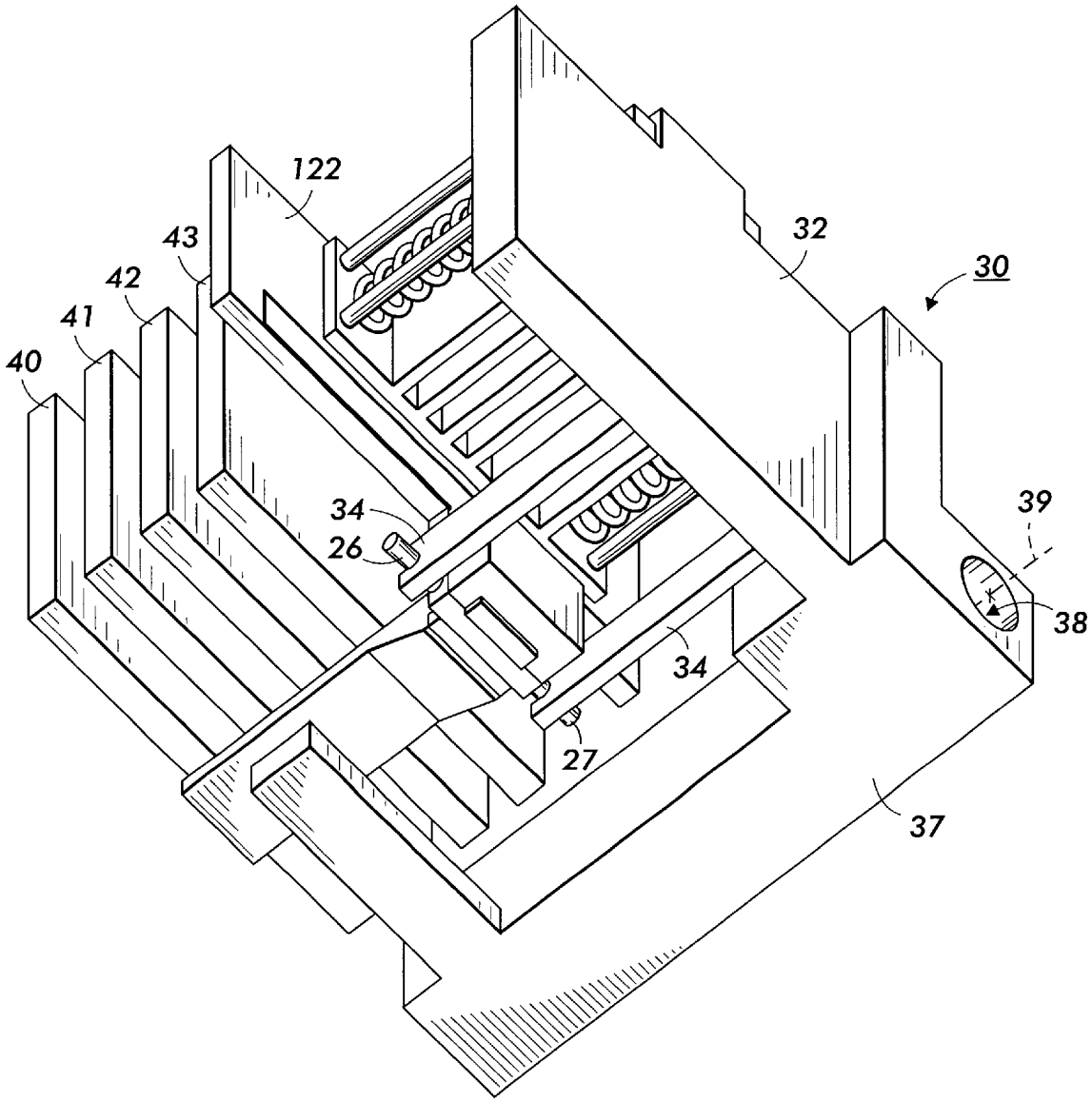
FIG. 6 is another perspective view of the exemplary embodiment of the heat sink of this invention shown in FIG. 4.

In operation, the ink cartridge 44 is installed into the ink manifold 25. The heat sink 110 is positioned on the guide rails 14, 15, 16 and 17. The printhead substrate 120 is attached to the carriage support 30 by the pivot pins 26 and 27 engaging with the carriage bottom 34, as best seen in FIG. 6. The carriage top 36 is latched over the top of the substrate, as best seen in FIG. 4. The springs 50 and 52 are compressed between the carriage back 32 and the heat sink 110. The springs 50 and 52, because they are under compression, tend to compress or urge the heat sink 110 against the back face 122 of printhead substrate 120.

As the inkjet printhead is used to form images on a recording medium, the substrate 120 becomes heated. Heat is efficiently and effectively transferred out through the back 122 of the substrate 120 and into the heat sink 110, and then out of the heat sink 110 into the surrounding environment. If the heat conductive layer 19 is provided between the heat sink 110 and the substrate 120, heat will be transferred out of the substrate 110, through the conductive layer 19, and into the heat sink 110, and then out of the heat sink 110 and into the surrounding environment.

This apparatus provides excellent thermal heat conduction because of the low contact resistance produced from using the springs 50 and 52 or spring clips to hold the print element, in this case the printhead 120, against the heat sink 110.

In one exemplary embodiment, the print substrate 120 is a standard configuration and the heat sink 110 can be custom fabricated depending on the requirements of heat dissipation and the available space within a printer box (not shown). The ability to de-couple the printhead 26 from the heat sink 30 provides for increased design freedom.

FIG. 9 schematically illustrates one exemplary embodiment for mounting the heat sink 310 to the printhead substrate 320 according to this invention. Compressed springs 350 and 352 are biased to press heat sink 310 against, and to remove heat from, the printhead substrate 320. A force, F2, is applied to press the printhead substrate 320 causing the substrate 320 to pivot inward about pin 326 against the bias of springs 350 and 352. Once the substrate 320 is far enough inward, a force, F1, can be applied, for example by finger 390, to allow a cam 395 in lever 336 to deflect the springs 350 and 352 the remaining distance until the printhead is statically locked into place. The radius of the lever 336 acts as a moment arm to make it easier for a person to press the faces of the heat sink 310 and the printhead substrate 320 together.

The higher the pressure applied by the springs 350 and 352 to force the heat sink 370 against the substrate 320, the lower the thermal resistance will be, as air is forced out of the interface between the two, and, thus, the higher the heat transfer between the two will be.

FIG. 10 provides an illustration of another exemplary embodiment for mounting a heat sink 410 having fins 413 to the inkjet substrate printhead 420 according to this invention. In FIG. 10, fasteners 450, 451, 452 and 453 are used to fasten the heat sink 410 against the inkjet printhead substrate 420.

The heat sink according to this invention may be formed from an anodized material to increase the emissivity for the heat sink surface. Also, contact between the heat sink 10, 110, 310 or 410 and the carriage enables the carriage itself to act as an extension of the heat sink, further increasing the surface area for heat transfer to the ambient environment, and thus increasing the ability of the heat sink 10, 110, 310 or 410 according to this invention to transfer heat out of the printhead substrate 20, 120, 320 or 420.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A thermal ink jet printer comprising:

a heat sink;

a printhead substrate;

a positioning device for aligning the heat sink against the printhead substrate; and a carriage with a carriage latch that pivots to removably position the heat sink within the positioning device in a floating manner against the printhead substrate.

2. The inkjet printer of claim 1 wherein the positioning device is a biasing device that supplies a bias force to bias a surface of the heat sink against a surface of the printhead substrate.

3. The inkjet printer of claim 2, further comprising a layer of heat conductive material between the heat sink surface and the printhead substrate surface.

4. The inkjet printer of claim 3, wherein the heat conductive material is a heat conductive polymer, an interface fluid, a liquid heat sink, a thermal grease or a thermal fabric.

5. The inkjet printer of claim 2, wherein the biasing device includes at least one spring.

6. The inkjet printer of claim 5, wherein the at least one spring is at least two springs.

7. The inkjet printer of claim 5, wherein the carriage has a surface, wherein each at least one spring has first and second ends, the first end of each spring engaged with the surface of the carriage, and the second end of each spring providing the biasing force against the heat sink.

8. The inkjet printer of claim 1, further comprising at least one heat sink guide rail, wherein the heat sink has at least one guide structure which corresponds to the at least one guide rail, such that the at least one guide rail guides the heat sink towards the printhead substrate.

9. The inkjet printer of claim 2, wherein the biasing device is at least one spring clip.

10. The inkjet printer of claim 1, further comprising at least one heat sink guide rail, wherein the heat sink has at least one guide structure which corresponds to the guide rail, such that the at least one guide rail guides the heat sink towards the printhead substrate.

11. The inkjet printer of claim 1, wherein the positioning device is an attaching device for attaching the heat sink to the printhead substrate.

12. The inkjet printer of claim 11, wherein the attaching device comprises at least one fastener fastening said heat sink directly to said printhead substrate.

13. A method of removing heat from an inkjet printhead substrate, comprising:

providing a printhead substrate;

providing a heat sink;

removably positioning the heat sink within a positioning device by pivoting a carriage latch mounted to a carriage such that the heat sink is positioned in a floating manner against the print head substrate.

14. The method of claim 13, wherein removably positioning the heat sink comprises biasing a surface of the heat sink against a surface of the printhead substrate at an interface between the heat sink surface and the printhead substrate surface.

15. The method of claim 13, further comprising:

providing a layer of conductive material between the heat sink surface and the printhead substrate surface; and conducting heat from said printhead substrate, through said layer of conductive material, into said heat sink, and out of said heat sink.

16. The method of claim 15, wherein the conductive material is a heat conductive polymer, an interface fluid, a liquid heat sink, a thermal grease material or a thermal fabric.

17. The method of claim 14, wherein biasing comprises compressing at least two springs between the surface of the heat sink and the surface of the printhead substrate.

18. The method of claim 17, wherein each spring has first and second ends, and the method further comprises:

engaging the first end of each spring with a surface of said carriage, and positioning the second end of each spring against said heat sink, to urge the heat sink against the printhead substrate.

19. The method of claim 13, wherein the heat sink is one of a finned plate heat sink having a plurality of fins extending outward from a base plate or a pinned plate heat sink having a plurality of pins extending outward from a base plate.

20. A thermal inkjet printer comprising:

a heat sink;

a printhead having a printhead substrate;

a positioning device for aligning the heat sink against the printhead substrate; and an easy-lock carriage with a carriage latch that pivots to removably position the heat sink within the positioning device against the printhead substrate in a floating manner.

* * * * *